US006942317B2

(12) United States Patent
Harrington

(10) Patent No.: US 6,942,317 B2
(45) Date of Patent: Sep. 13, 2005

(54) FLUID EJECTING HEAD AND FLUID EJECTING METHOD USING THE FLUID EJECTING HEAD

(75) Inventor: Steven J. Harrington, Webster, NY (US)

(73) Assignee: Xerox Corporation, Stamford, CT (US)

( * ) Notice: Subject to any disclaimer, the term of this patent is extended or adjusted under 35 U.S.C. 154(b) by 105 days.

(21) Appl. No.: 10/248,611

(22) Filed: Jan. 31, 2003

(65) Prior Publication Data

US 2004/0150680 A1 Aug. 5, 2004

(51) Int. Cl.[7] ..... B41J 2/21
(52) U.S. Cl. ..... 347/43
(58) Field of Search ..... 347/9, 12, 40, 347/41, 43, 19, 14, 10, 24, 5, 11, 8, 23, 20, 42; 358/1.16

(56) References Cited

U.S. PATENT DOCUMENTS 6,124,946 A * 9/2000 Norton ..... 358/1.9
6,313,922 B1 * 11/2001 Jackson ..... 358/1.16
6,364,452 B1 * 4/2002 Noyes et al. ..... 347/43
6,824,239 B1 * 11/2004 Hanabusa et al. ..... 347/15

* cited by examiner

*Primary Examiner*—Stephen Meier
*Assistant Examiner*—Julian D. Huffman
(74) *Attorney, Agent, or Firm*—Oliff & Berridge, PLC

(57) ABSTRACT

One of the sections of nozzles of a fluid ejection head ejects a first one of different fluids and has a width in the process direction that is N times wider than the width in the process direction of other sections of the fluid ejection head. Data corresponding to the first one of the different fluids is collected in a first data buffer until the first data buffer is full. The fluid ejection head is controlled to eject all of the different fluids only when the first data buffer is full.

17 Claims, 6 Drawing Sheets

FLUID EJECTING HEAD AND FLUID EJECTING METHOD USING THE FLUID EJECTING HEAD

BACKGROUND OF THE INVENTION

1. Field of Invention

This invention is related to fluid ejecting head configurations and buffering methods for improving the speed of ejecting fluid from the fluid ejecting head.

2. Description of Related Art

In thermal ink jet printing, the printhead typically includes one or more ink ejectors. Each ejector includes a channel that communicates with an ink supply chamber, or manifold, at one end and an opening at the opposite end of each ejector. The opening at the opposite end of each ejector is referred to as a nozzle. Ink is expelled from each nozzle by known printing processes, such as "drop-on-demand" printing or continuous stream printing.

In a color ink jet printing apparatus, the printhead typically includes a linear array of ejectors. The printhead is moved relative to the surface of the print sheet, either by moving the print sheet relative to a stationary printhead, or vice versa, or both. In known ink jet printing apparatus, a printhead reciprocates across a print sheet numerous times in the course of printing an image. Each pass of the printhead across the print sheet is referred to as a swath. As the printhead and the print sheet are moved relative to each other, imagewise digital data is used to selectively activate the ink ejectors in the printhead to generate a desired image.

SUMMARY OF THE INVENTION

It is known in the art of color ink jet printing to use a single print head that is divided into sections for each respective color ink. The color inks typically include cyan, magenta, yellow and black. Thus, the single print head is divided into four sections, each section ejecting color ink of cyan, magneta, yellow and black, respectively.

The size of the four sections of the ink jet printhead are typically of equal size. When printing a color image on a page, the page is advanced only a quarter of the head width on each swath. Thus, color printing will occur at a quarter of the speed of black printing if the black printing is done using a black-only cartridge.

The reduced speed of the conventional sectional printhead is most problematic when printing images that are primarily black and white, but also include a little color. Such images include graphics in a text document, or highlight colors in a logo. In these situations, the image will print slowly even though there is little color in the image.

This invention provide systems and methods that allow a printhead to more quickly print color portions of an image.

This invention separately provides systems and methods that reduce the number of swaths in which the printhead must sweep across the entire width of the sheet when printing a full color image that is located on only a portion of the sheet.

This invention separately provides systems and methods that allows for uniform use of the black ink jets on the printhead.

In various exemplary embodiments, the systems and methods according to this invention control a fluid ejecting apparatus having a reciprocable fluid ejection head to print swaths of at least one fluid on a receiving medium based on received ejection data. The fluid ejection head has a plurality of sections of nozzles that extend parallel to a process direction of the receiving medium and that eject different fluids. A first one of the sections of nozzles ejects a first one of the different fluids and has a width in the process direction that is at least N times wider than the width in the process direction of the other sections. Ejection data is received from a data source. Data corresponding to the first one of the different fluids is collected from the data in a first data buffer until the first data buffer is full. In various exemplary embodiments, the fluid ejection head is controlled to eject the first fluid only when the first data buffer is full, such that the fluid ejection head ejects fluid from the first section of nozzles only in one out of every N swaths and the portion of that one of every N swaths receiving the first fluid will be N times wider than the width of the other portions of that swath that receive fluids other than the first fluid.

In various other exemplary embodiments, when less than N portions of the first fluid have been buffered, a determination is made whether the width of a swath needed to lay down one of the other fluids is wider than that needed to lay down any of the buffered swaths of the first fluid. If so, even if there are less than N portions of the first fluid buffered, the buffered portions of the first fluid are ejected along with the other fluids to be ejected.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

The following detailed description of various exemplary embodiments of the fluid ejection systems according to this invention are directed to one specific type of fluid ejection system, an ink jet printer, for sake of clarity and familiarity. However, it should be appreciated that the principles of this invention, as outlined and/or discussed below, can be equally applied to any known or later developed fluid ejection system that ejects two or more different kinds of fluids, beyond the ink jet printer specifically discussed herein.

Figure 1:
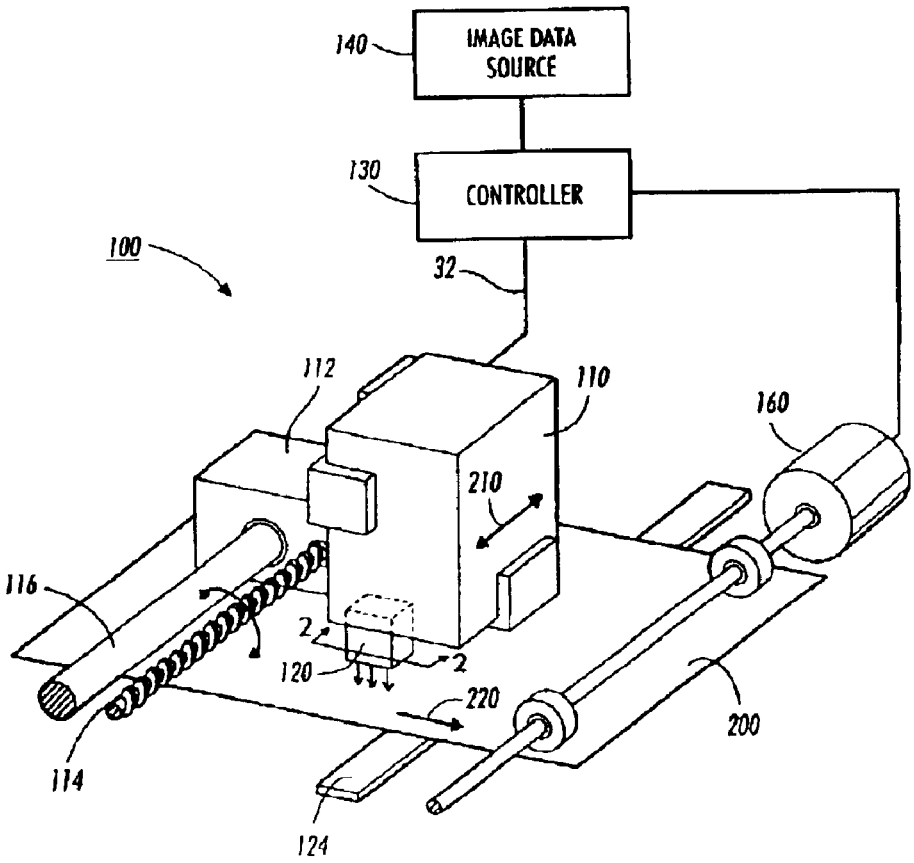
FIG. 1 shows a reciprocating-carriage-type thermal ink-jet printer usable with the various exemplary embodiments of the methods and apparatus according to this invention.

FIG. 1 shows a reciprocating-carriage-type ink-jet printer 100 usable with the various exemplary embodiments of the methods and systems according to this invention. The ink jet printer 100 creates color or monochrome images on a sheet of recording medium 200. An ink cartridge 110 is, in various exemplary embodiments, removably mounted on a carriage 112. The ink cartridge 110 contains a plurality of ink supplies (not shown). A rotatable lead screw 114 has threads which interact with a structure (not shown) on the carriage 112 so that, when the lead screw 114 is rotated by a motor (not shown), the interaction of the threads of the lead screw 114 with the structure on carriage 112 will cause the carriage 112 and the cartridge 110 to move in a fast scan, or swath, direction 210. The sheet of recording medium 200 moves in slow scan, or process, direction 220 using a stepper motor or other indexing motor 160. The indexing motor 160 holds the sheet of recording medium 200 in a stationary position while the cartridge 110 moves across the sheet in the fast scan, or swath, direction 210, and then indexes the sheet of recording medium 200 in slow scan, or process, direction 220 between swaths. Further mechanical stability is provided for the motion of carriage 112 by, for example, a stabilizing rod 116 which passes through an opening in the carriage 112.

A printhead 120 is provided on a bottom of the cartridge 110, as shown in FIG. 1. The front face of the print head 120 is directed downward toward the sheet of recording medium 200. The printhead 120 comprises two or more linear arrays of ejectors, such as the arrays 124 and 127–129 shown in FIG. 2. Each ejector is operatively connected to a particular ink supply. Generally, the linear arrays 124 and 127–129 of ejectors of the printhead 120 extends in a direction parallel to slow scan, or process, direction 220, so that, when the cartridge 110 moves along the fast scan, or swath, direction 210, the linear arrays will "sweep" across the sheet of recording medium 200 for an appreciable length, thus creating a print swath. While the carriage 110 moves across the sheet of recording medium 200, the various ejectors in each of the two or more linear arrays 124 and 127–129 are operated to emit controlled quantities of fluids in an image-wise fashion, thus creating the desired image on the sheet of recording medium 200.

A controller 130 is connected by a bus 132 to the printhead 120. An image data source 140 inputs image data in digital form to the controller 130. The image data source 140 can be a digital camera, a scanner, or a locally or remotely located computer, or any other known or later-developed device that is capable of generating and/or supplying electronic image data. Similarly, the image data source 140 can be any suitable device that stores and/or transmits electronic image data, such as a client or a server of a network. The controller 130 coordinates the firing of the various ejectors in the printhead 120 with the motion of cartridge 110 in fast scan or swath direction 210, and with the slow scan or process direction 220 of recording medium 200, so that a desired image in accordance with the digital data is rendered in the fluids on the recording medium 200. The controller 130 coordinates the position of the printhead 120 relative to the recording medium 200 to activate the various ejectors as needed, in a manner generally familiar to one skilled in the art of inkjet printing. The controller 130 can also control the various motors, such as the indexing motor 160, which controls the position of recording medium 200 along slow scan or process direction 220. The controller 130 can also control the motion of the carriage 112 through means not shown.

Figure 2:
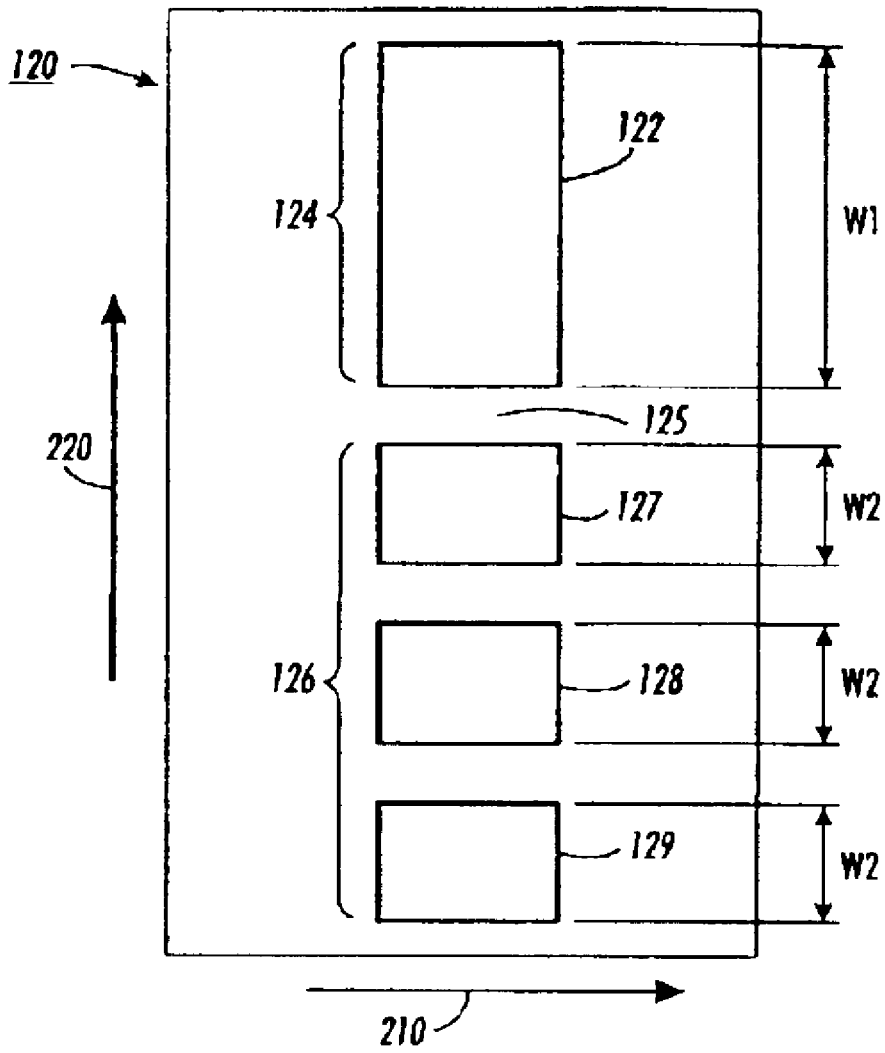
FIG. 2 is a front plan view of one exemplary embodiment of a front face of the printhead according to this invention.

FIG. 2 is a front plan view of one exemplary embodiment of a front face of the printhead according to this invention. The printhead 120 includes a number of linear arrays 124 and 127–129 of the ejectors 122. The linear arrays 124 and 127–129 of the ejectors 122 are aligned parallel with the slow scan or process direction 220 and perpendicular to the fast scan or swath direction 210. The linear arrays 124 and 127–129 of ejectors 122 are divided into two sections, a trailing section containing a first linear array 124, and a leading section 126, containing the linear arrays 127–129. In the exemplary embodiment shown in FIG. 2, the trailing section of the linear array 124 in the slow scan direction 220 includes ejectors that eject a first fluid, such as black ink. Each of the linear arrays 127, 128, and 129 includes ejectors 122 that eject a fluid different from each other and from the first fluid. The fluids ejected by the linear arrays 127–129 can be subtractive color inks, such as cyan, magenta and yellow ink, respectively. Although the linear arrays 124 and 127–129 are shown spaced by one or more gaps 125, it should be appreciated that the linear arrays 124 and 127–129 of the ejectors 122 emitting different fluids could abut each other with no gaps.

It should be appreciated that, in various exemplary embodiments used to print color images using ink, the trailing section containing the linear array 124 ejects black ink. However, in other exemplary embodiments, the trailing section containing the linear array 124 could eject ink of any desired color.

In the embodiment shown in FIG. 2, the width W1 of the trailing linear array 124 is three times the width W2 of each of the linear arrays 127, 128 and 129. However, it should be appreciated that the width W1 of the trailing linear array 124 could be any integer multiple of the width W2 of each of the linear arrays 127, 128, 129. Because the linear array 124 is relatively wide, printing a black-only image is relatively rapid because fewer swaths are required. However, when full-color image is to be printed using the subtractive color inks from the linear arrays 127, 128 and 129, the maximum effective swath width, and therefore the maximum operating speed, of the ink jet printer 100 is restricted by the smallest width W2 of the linear arrays 127, 128 and 129. For example, the width W2 of each linear array 127, 128, 129 is one-third that of the linear array 124. Thus, three times as many swaths are needed to cover a recording medium. Additionally, following each swath, the recording medium can be indexed in the slow scan or process direction 220 only by distance of the width W2 of one of the linear arrays 127, 128 and 129. Therefore, the image formed using the fluid ejected by the linear array 124 may be printed at three times the speed of an image that uses one or more of the fluids ejected by one or more of the linear array 127–129 because the effective swath width W1 of the linear array 124 is three times wider than the effective swath width W2 of the linear array 127, 128 and 129.

Images, such as logos, often are printed primarily using a black and white image with some highlight coloring. Also, many documents have black and white text, with color images positioned in limited regions of the image, such as, for example, printed next to or below the text. The printhead 120 shown in FIG. 2 sacrifices speed of color printing for improved performance in the black and white areas of the document.

In a first exemplary embodiment of the systems and methods according to this invention, first fluid data is collected until a corresponding first fluid data buffer is full, even when there is data for a second, a third and/or a fourth fluid present. Specifically, swaths of the second-fourth fluids are printed with null first fluid data until the first fluid data buffer is full. Thus, if the first fluid linear array 124 of the printhead is N blocks wide, while the second-fourth linear arrays 127–129 are each one block wide, when printing regions containing one or more of the second-fourth fluids, N−1 swaths will be printed using only the second-fourth fluids. In other words, all of the first and second-fourth fluids will be printed in only one out of every N swaths, but the first fluid portion during that swath will be N times wider than any of the other second-fourth fluid portions.

For example, when the first-fourth fluids are differently colored inks, in this first exemplary embodiment of the systems and methods according to this invention, black data is collected until a black data buffer is full, even when there is color present. Specifically, swaths of color are printed with null black data until the black data buffer is full. Thus, if the black section of the printhead is N blocks wide, when printing full color regions, N−1 swaths will be printed using only the colored inks. Then, black and color inks will all be printed only one out of every N swaths, but the black portion will be N times wider than any of the other colors.

Figure 3:
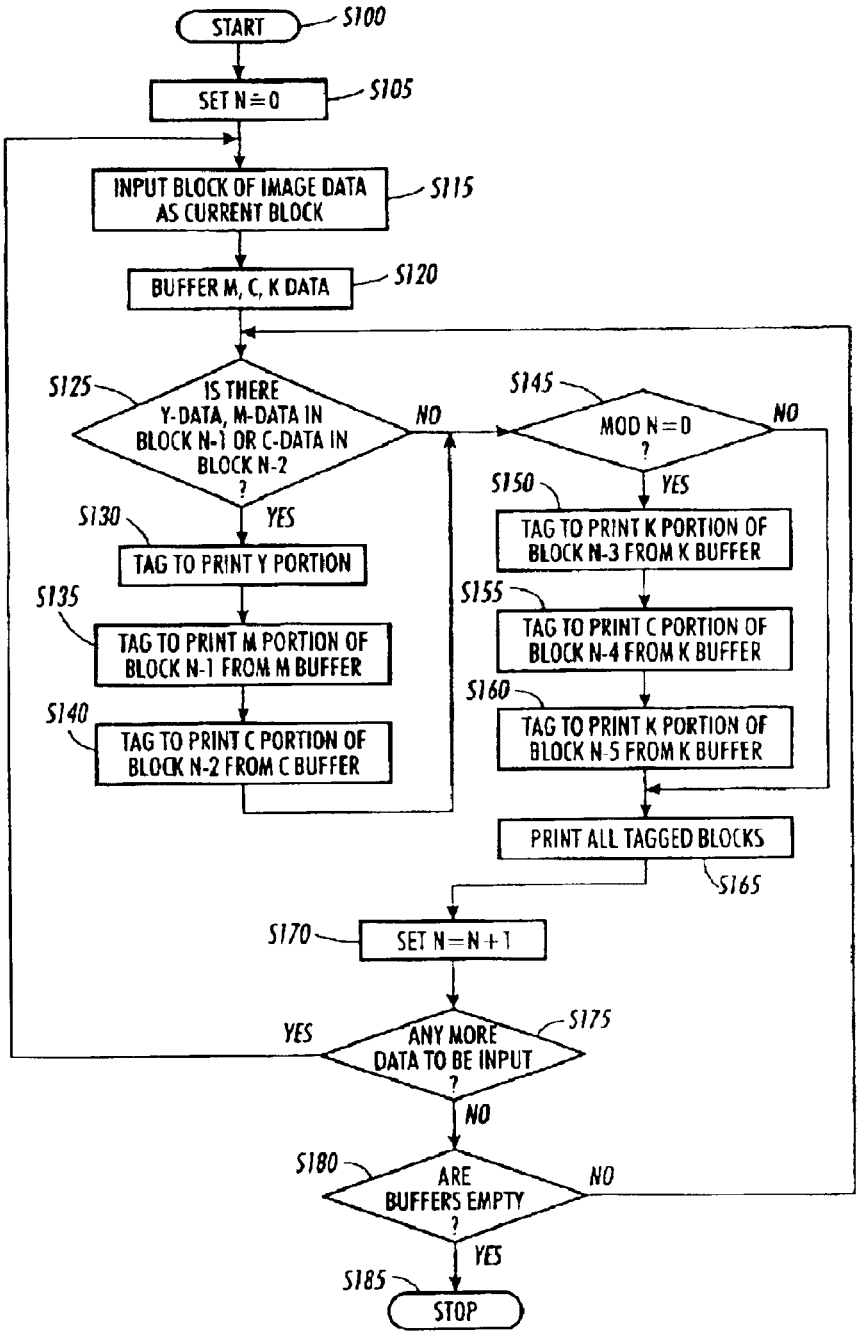
FIG. 3 is a flowchart outlining one exemplary embodiment of a method for providing an image according to this invention.

FIG. 3 is a flowchart outlining this first exemplary embodiment of a method for providing an image according to this invention. For ease of explanation only, the following description will use color inks as the fluids to be ejected. Beginning in step S100, operation continues to step S105, where a counter N is set equal to 1. Then, in step S115, a block of image data is received from an image data source as the current block. Next, in step S120, any magenta, cyan and black data from the image data within the current block N is buffered. Then, in step S125, a determination is made if there is yellow data in block N, magenta data in block N−1, and/or cyan data in block N−2. If there is yellow data in block N, magenta data in block N−1 and/or cyan data in block N−2, operation continues to step S130. Otherwise, operation jumps directly to step S145.

In step S130, the yellow portion of image data in the current block N is tagged for printing. Next, in step S135, the magenta portion of image data of block N−1 from the magenta buffer is tagged for printing. Then, in step S140, the cyan portion of image data of block N−2 from the cyan buffer is tagged for printing. Operation then continues to step S145.

In step S145, a determination is made if $\text{Mod}_3$ N is equal to zero. If $\text{Mod}_3$ N is equal to zero, then operation continues to step S150. Otherwise, operation jumps to step S165. In step S150, the black portion of image data of block N−3 from the black buffer is tagged for printing. Then, in step S155, the black portion of image data of block N−4 from the black buffer is tagged for printing. Next, in step S160, the black portion of image data of block N−5 from the black buffer is tagged for printing. Operation then continues to step S165.

In step S165, all tagged blocks of image data are printed. Then, in step S170, N is set equal to N+1. Operation then continues to step S175, where a determination is made if there is anymore data to be input. If there is more data to be input, operation returns to step S115. Otherwise, operation continues to step S180.

In step S180, a determination is made if the buffers are empty. If the buffers are not empty, operation returns to step S125. Otherwise, operation continues to step S185, where operation of the method ends.

Figure 4:
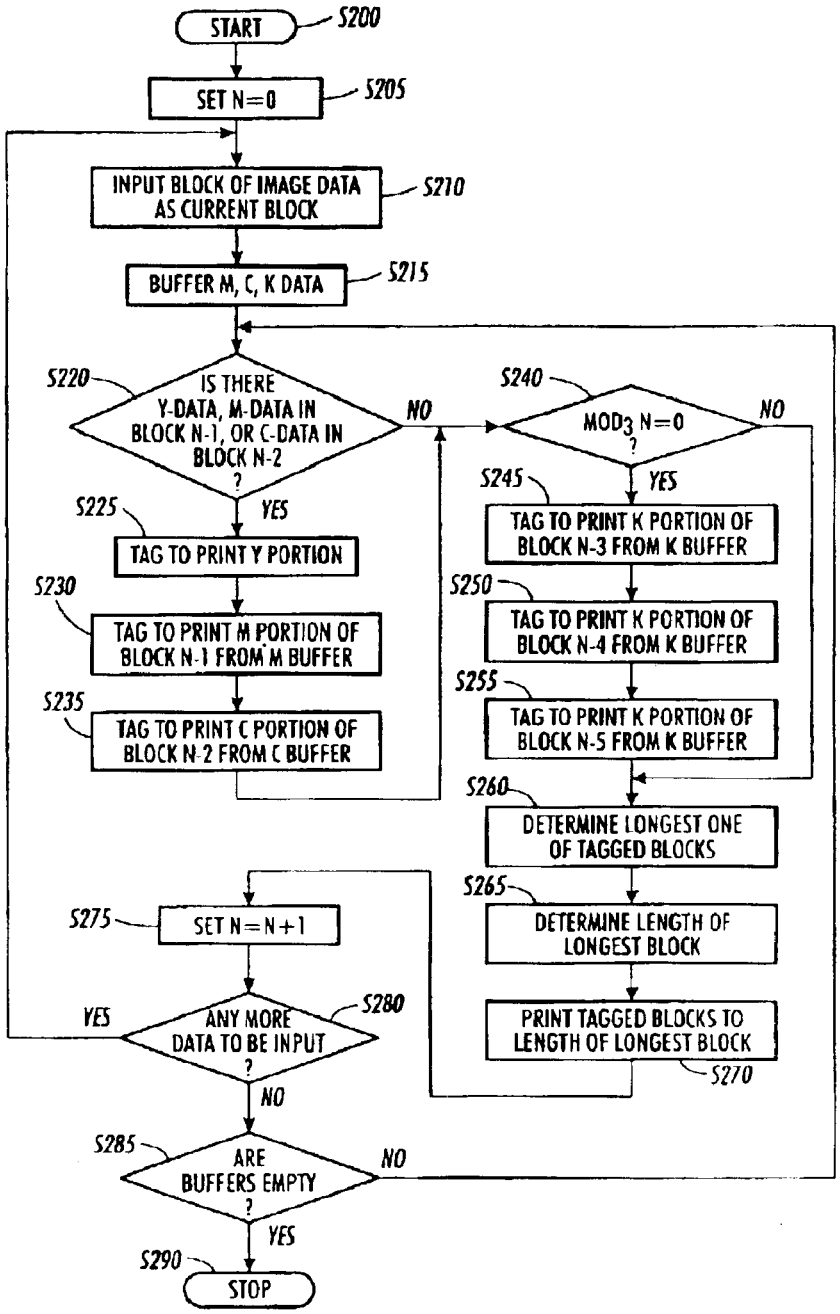
FIG. 4 is a flowchart outlining a second exemplary embodiment of a method for providing an image according to this invention.

FIG. 4 is a flowchart outlining a second exemplary embodiment of a method for providing an image according to this invention. As shown in FIG. 4, beginning in step S200, operation continues to step S205, where a counter N is set equal to 1. Then, in step S210, a block of image data is input from an image data source as the current block N. Next, in step S215, any magenta, cyan and black data of the image data within the current block N is buffered. Then, in step S220, a determination is made whether there is yellow data in block N, magenta data in block N−1, and/or cyan data in block N−2. If there is yellow data in block N, magenta data in block N−1and/or cyan data in block N−2, then operation continues to step S225. Otherwise, operation jumps directly to step S240.

In step S225, the yellow portion of the image data from the current block N is tagged for printing. Next, in step S230, the magenta portion of the image data of block N−1from the magenta buffer is tagged for printing. Then, in step S235, the cyan portion of image data of block N−2from the cyan buffer is tagged for printing. Operation then continued to step S240.

In step S240, a determination is made whether $\text{Mod}_3$ N is equal to zero. If $\text{Mod}_3$ N is equal to zero, operation continues to step S245, otherwise, operation jumps to step S260. In step S245, the black portion of image data of block N−3 from the black buffer is tagged for printing. Then, in step S250, the black portion of image data of block N−4from the black buffer is tagged for printing. Next, in step S255, the black portion of image data of block N−5from the black buffer is tagged for printing. Operation then continues to step S260.

In step S260, the longest one of the tagged blocks is determined. Then, in step S265, the length of the longest block is determined. Next, in step S270, the tagged blocks are printed to the length of the longest block. Then, in step S275, counter N is set equal to N+1. Operation then continues to step S280.

In step S280, a determination is made whether there is anymore data to be input. If there is anymore data to be input, operation returns to step S210. Otherwise, operation continues to step S285. In step S285, a determination is made whether the buffers are empty. If the buffers are not empty, operation returns to step S220. Otherwise, operation continues to step S290, where operation of the method ends.

Figure 5:
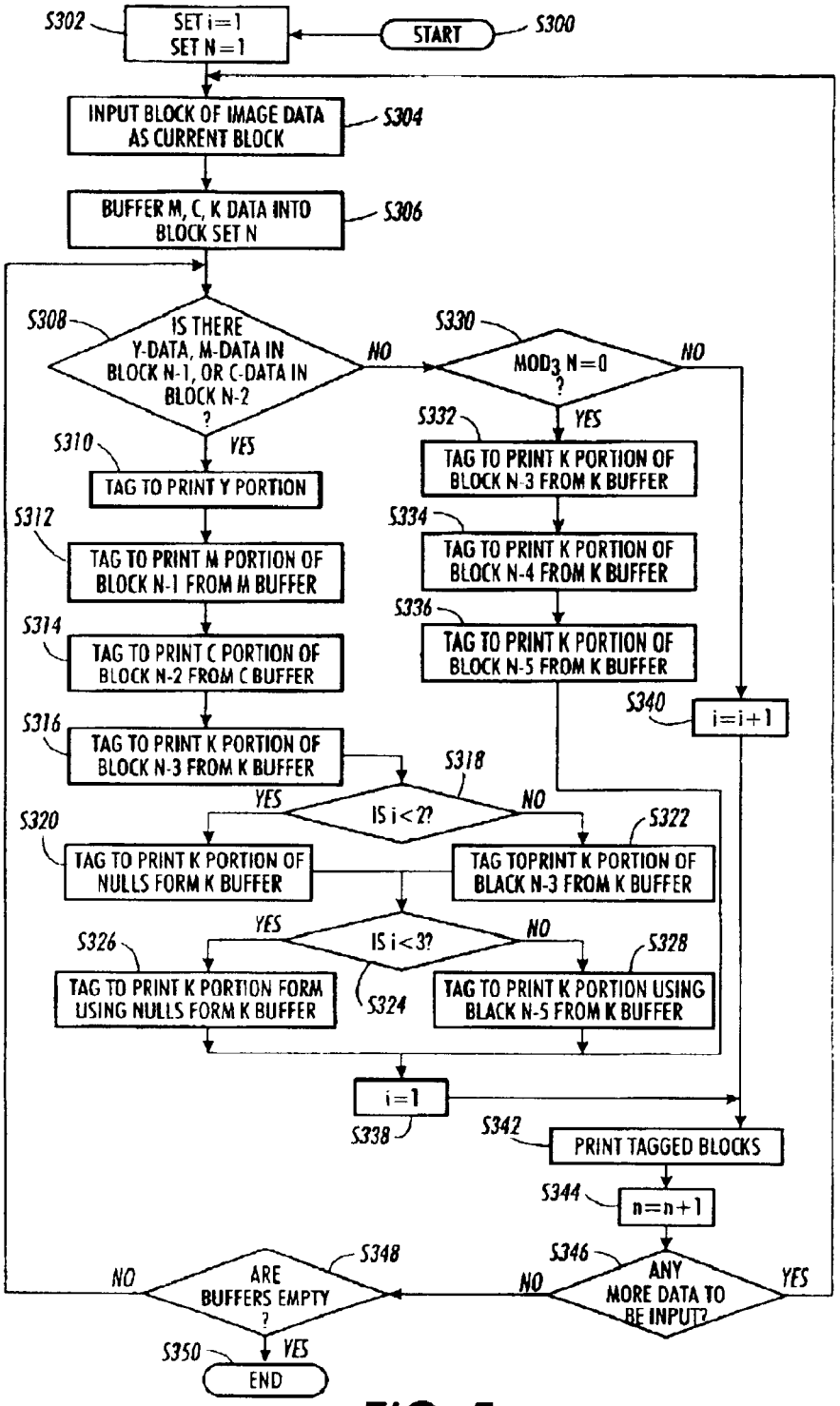
FIG. 5 is a flowchart outlining a third exemplary embodiment of a method for providing an image according to this invention.

FIG. 5 is a flowchart outlining a third exemplary embodiment of a method for providing an image according to this invention. As shown in FIG. 5, beginning in step S300, operation continues to step S302, where counters i and N are set equal to 1. Then, in step S304, a block of image data is input from an image data source as the current block. Next, in step S306, any magenta, cyan and black data of the image data within the current block N is buffered. Then, in step S308, a determination is made whether there is yellow data in block N, magenta data in block N−1and/or cyan data in block N−2. If there is yellow data in block N, magenta data in block N−1and/or cyan data in block N−2, operation continues to step S310. Otherwise, operation jumps to step S332.

In step S310, the yellow portion of the image data from the current block N is tagged for printing. Next, in step S312, the magenta portion of image data of block N−1 from the magenta buffer is tagged for printing. Then, in step S314, the cyan portion of image data of block N−2 from the cyan buffer is tagged for printing. Operation then continues to step S316.

In step S316, the black portion of image data of block N−3 from the black buffer is tagged for printing. Then, in step S318, a determination is made whether i is less than 2. If i is less than 2, operation continues to step S320. Otherwise, operation jumps to step S322. In step S320, a portion of null data in place of any data for the black buffer stored in the N−4 portion is tagged for printing. Operation then jumps to step S324. In contrast, in step S322, the black portion of the image data for the block N−4 stored in the black buffer is tagged for printing. Operation then continues to step S324.

In step S324, a determination is made whether i is less than 3. If i is less than 3, then operation continues to step S326. Otherwise, operation jumps to step S328. In step S326, a portion of null data in place of any data for the black buffer stored in the N−5 portion is tagged for printing. Operation the jumps to step S330. In contrast, in step S328, the black portion of the image data for the block N−5 stored in the black buffer is tagged for printing. Operation the turns to step S338.

In step S330, a determination is made whether $\text{Mod}_3$ N is equal to zero. If $\text{Mod}_3$ N is equal to zero, operation continues to step S332. Otherwise, operation jumps to step S340.

In contrast, in step S332, the black portion of image data of block N−3 from the black buffer is tagged for printing. Then, in step S334, the black portion of image data of block N−4 from the black buffer is tagged for printing. Next, in step S336, the black portion of image data of block N−5 from the black buffer is tagged for printing. Operation then continues to step S338, where i is set equal to 1. Operation then jumps to step S342. In contrast, in step S340, i is set equal to i+1. Operation then continues to step S342.

In step S342, all tagged blocks are printed. Then, in step S344, N is set equal to N+1. Next, in step S346, a determination is made whether there is anymore data to be input. If there is more data to input, then operation returns to step S304. Otherwise, operation continues to step S348, where a determination is made whether the buffers are empty. If the buffers are not empty, then operation returns to step S308. Otherwise, operation continues to step S350, where operation of the method ends.

Figure 6:
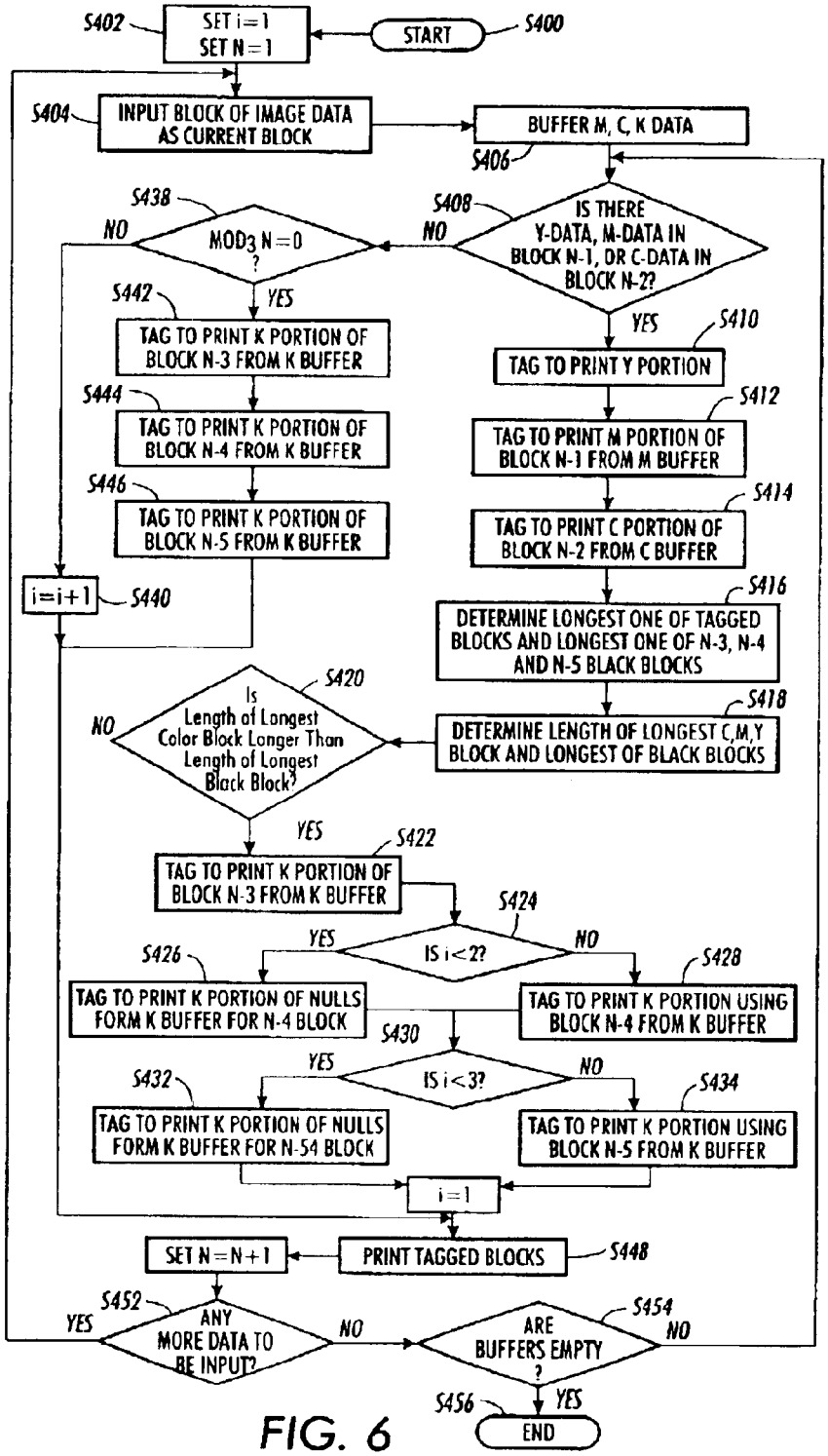
FIG. 6 is a flowchart outlining a fourth exemplary embodiment of a method for providing an image according to this invention.

FIG. 6 is a flowchart outlining a fourth exemplary embodiment of a method for providing an image according to this invention. As shown in FIG. 6, beginning in step S400, operation continues to step S402, where a counter i is set equal to 1 and a counter N is set equal to 1. Then, in step S404, a block of image data is input from an image data source as the current block. Next, in step S406, any magenta, cyan and black data within the current block N is buffered. Then, in step S408, a determination is made whether there is yellow data, magenta data in block N−1and/or cyan data in block N−2. If there is yellow data, magenta data in block N−1 and/or cyan data in block N−2, operation continues to step S410. Otherwise, operation continues to step S438.

In step S410, the yellow portion of image data of the current block N is tagged for printing. Next, in step S412, the magenta portion of the data of block N−1 from the magenta buffer is tagged for printing. Then, in step S414, the cyan portion of the data of block N−2 from the cyan buffer is tagged for printing. Operation then continues to step S416.

In step S416, the longest one of tagged blocks are determined and the longest one of the N−3, N−4 and N−5 black blocks are determined. Then, in step S418, the length of the longest cyan, magenta and/or yellow blocks and longest one of the black blocks are determined. Next, in step S420, a determination is made whether the longest cyan, magenta and yellow block is longer than the longest black block. If the length of the longest cyan, magenta or yellow block is longer than the longest black block, operation continues to step S422. Otherwise, operation jumps to step S438.

In step S422, the black portion of data of block N−3 from the black buffer is tagged for printing. Next, in step S424, a determination is made whether i is less than 2. If i is less than 2, operation continues to step S426. Otherwise, operation continues to step S428. In step S426, a portion of null data in place of any data in the black buffer stored in the N−4portion for the N−4 block is tagged for printing. In contrast, in step S428, the black portion of the image data for the block N−4 stored in the black buffer is tagged for printing. Operation continues to step S430.

In step S430, a determination is made whether i is less than 3. If i is less than 3, operation continues to step S432. Otherwise, operation jumps to step S434. In step S432, a portion of null data in place of any data in the black buffer stored in the N−5 portion for the N−5block is tagged for printing. Operation then jumps to step S436. In contrast, in step S434, the black portion of the image data for the block N−5 stored in the black buffer is tagged for printing. Operation then continues to step S436, where i is set equal to 1. Operation then jumps to step S448.

In contrast, in step S438, a determination is made whether $\text{Mod}_3$ N is equal to zero. If $\text{Mod}_3$ N is equal to zero, operation jumps to step S442. Otherwise, operation continues to step S440, where i is set equal to i+1. Operation then jumps to step S448.

In contrast, in step S442, the black portion of the image data for the block N−3 stored in the black buffer is tagged for printing. Then, in step S444, the black portion of the image data for the block N−4 stored in the black buffer is tagged for printing. Next, in step S446, the black portion of the image data for the block N−5 stored in the black buffer is tagged for printing. Operation then continues to step S448.

In step S448, all tagged blocks are printed. Next, in step S450, the counter N is set equal to N+1. Then, in step S452, a determination is made whether there is anymore data to be input. If there is more data to be input, then operation returns to step S404. Otherwise, operation continues to step S454, where a determination is made whether the buffers are empty. If the buffers are not empty, operation returns to step S408. Otherwise, operation continues to step S456, where operation of the method ends.

One advantage of various ones of the various exemplary embodiments of the systems and methods according to this invention is that, for those swaths that print without black, the print head need only move the width of the colored areas. This can save time if the size of the colored area is small. For example, if the page has a small colored picture or graphic amidst black text, the print head only has to move across the colored region for the swaths where only color is printed. The head must move across both the colored and black regions only in one out of N swaths.

The exemplary embodiments of the methods according to this invention also allows uniform use of the black print head as well as improving performance on some images. However, it requires that null image data be provided to the black section of the head for some swaths. This can be done by masking the data as it is sent to the printhead. Alternatively, the actual black data and the null data can be separately buffered.

While this invention has been described in conjunction with the specific exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method for controlling a fluid ejecting apparatus having a reciprocable fluid ejection head to print swaths in as swath direction of at least one fluid on a receiving medium based on received ejection data, the fluid ejection head having a plurality of sections of nozzles that extend parallel to a process direction of the receiving medium and that eject different fluids, a first one of the sections of nozzles ejecting a first one of the different fluids and having a width in the process direction that is at least N times wider than the width in the process direction of each one of the other sections, where N is a number greater than one, the method comprising:

receiving the ejection data from a data source;

collecting data corresponding to the first one of the different fluids from the data in a data buffer until the data buffer is full;

controlling the fluid ejection head to eject the first fluid only when the data buffer is full, such that the fluid ejection head ejects fluid from the first section of nozzles only in one out of every N swaths an the portion of that one of every N swaths receiving the first fluid will be N times wider than the width of each one of the other portions of that swath that receive fluids other than the first fluid.

2. The method of claim 1, wherein N is an integer multiple of two or greater.

3. The method of claim 1, further comprising:

determining which section on the fluid ejection head has a longest swath length in the swath direction; and determining the length of the longest swath length.

4. The method of claim 3, further comprising:

controlling the fluid ejection head such that the swath length of the fluid ejection head is only as long as the length of the determined longest swath length.

5. The method of claim 3, further comprising:

controlling the fluid ejecting head to eject fluids other than the first fluid from the other sections of the fluid ejecting head even when the data buffer is not full and when the section that has the determined longest swath length is one of the sections that ejects fluid other than the first fluid.

6. The method of claim 1, further comprising advancing the receiving medium a swath distance in the process direction after the fluid ejection head ejects a swath of fluid on the receiving medium.

7. The method of claim 1, further comprising controlling the fluid ejection head to eject only fluids other than the first fluid when the data buffer is not full.

8. The method of claim 1, wherein the one of the sections is a trailing section in the process direction of the receiving medium.

9. The method of claim 1, wherein the first fluid is black ink, and the fluids other than the first fluid are inks of colors other than black.

10. A fluid ejecting apparatus, comprising:

a reciprocable fluid ejection head that prints swaths of received data in a swath direction on a receiving medium, the fluid ejection head having a plurality of sections of nozzles that extend in a process direction of the fluid ejection apparatus and that eject different fluids, a first one of the sections of nozzles ejecting a first one of the different fluids and having a width in the process direction that is N times wider than the width in the process direction of each one of the other sections, where N is a number greater than one;

a data input at which data corresponding to the different fluids is received;

a data buffer that collects data corresponding to the first fluid from the data received at the data input;

a controller that controls the fluid ejection head to eject the first fluid only when the data buffer is full, such that the fluid ejection head ejects fluid from the first section of nozzles only in one out of every N swaths an the portion of that one of every N swaths receiving the first fluid will be N times wider than the width of each one of the other portions of that swath that receive fluids other than the first fluid.

11. The fluid ejecting apparatus of claim 10, wherein N is an integer multiple of two or greater.

12. The fluid ejecting apparatus of claim 10, wherein the controller controls the fluid ejecting head to eject fluids other than the first fluid from the other sections of the fluid ejecting head even when the data buffer is not full.

13. The fluid ejecting apparatus of claim 10, wherein the controller controls the fluid ejection head such that the swath length in the swath direction of the fluid ejection head is only as long as the length of a determined longest swath length of the sections of the fluid ejection head.

14. The fluid ejecting apparatus of claim 10, wherein the controller controls the fluid ejection head to eject fluids other than the first fluid from the other sections of the fluid ejecting head even when the data buffer is not full and when the section that has the determined longest swath length is one of the sections that ejects fluid other than the first fluid.

15. The fluid ejecting apparatus of claim 10, wherein the first section is a trailing section in the process direction of the receiving medium.

16. The fluid ejecting apparatus of claim 10, the first fluid is black ink, and the fluids other than the first fluid are inks of colors other than black.

17. A method for controlling a fluid ejecting apparatus having a reciprocable fluid ejection head to print swaths of at least one fluid on a receiving medium based on received ejection data, the fluid ejection head having a plurality of sections of nozzles that extend parallel to a process direction of the receiving medium and that eject different fluids, a first one of the sections of nozzles ejecting a first one of the different fluids and having a width in the process direction that is at least N times wider than the width in the process direction of the other sections, where N is a number greater than one, the method comprising:

receiving the ejection data from a data source;

collecting data corresponding to the first one of the different fluids from the data in a first data buffer until the first data buffer is full;

collecting data corresponding to another one of the different fluids from the data in another data buffer;

controlling the fluid ejection head to eject the another fluid;

controlling the fluid ejection head to eject the first fluid only when the first data buffer is full.

* * * * *